US011685872B2

(12) United States Patent
Hughes et al.

(10) Patent No.: US 11,685,872 B2
(45) Date of Patent: Jun. 27, 2023

(54) METHOD FOR REDUCING PISTON DEPOSITS IN A MARINE DIESEL ENGINE

(71) Applicant: Infineum International Limited, Abingdon (GB)

(72) Inventors: Jonathan M. Hughes, Abingdon (GB); Timothy M. Clitherow, Didcot (GB); Adam P. Marsh, Witney (GB)

( * ) Notice: Subject to any disclaimer, the term of this patent is extended or adjusted under 35 U.S.C. 154(b) by 86 days.

(21) Appl. No.: 16/987,694

(22) Filed: Aug. 7, 2020

(65) Prior Publication Data

US 2021/0047576 A1 Feb. 18, 2021

(30) Foreign Application Priority Data

Aug. 15, 2019 (EP) ..... 19191918

(51) Int. Cl.

| | |
|---|---|
| ***C10L 10/04*** | (2006.01) |
| ***C10L 10/06*** | (2006.01) |
| ***C10L 1/16*** | (2006.01) |
| ***C10L 1/196*** | (2006.01) |
| ***C10L 1/14*** | (2006.01) |

(52) U.S. Cl.

CPC ..... *C10L 10/04* (2013.01); *C10L 1/143* (2013.01); *C10L 1/1616* (2013.01); *C10L 1/196* (2013.01); *C10L 10/06* (2013.01); *C10L 2270/026* (2013.01)

(58) Field of Classification Search

CPC ..... C10N 2010/04; C10N 2010/02; C10N 2020/04; C10N 2060/14; C10N 2030/04; C10N 2040/252; C10M 2207/144; C10M 2207/262; C10M 2215/28; C10M 2223/045; C10M 169/045; C10M 2203/1025; C10M 2207/127; C10M 2207/129; C10L 10/04; C10L 10/06; C10L 1/143; C10L 1/1616; C10L 1/196; C10L 2270/026

See application file for complete search history.

(56) References Cited

U.S. PATENT DOCUMENTS

2009/0291869 A1* 11/2009 Gregory ..... C10M 159/22 508/460
2019/0002788 A1* 1/2019 Gill ..... C10M 159/22

FOREIGN PATENT DOCUMENTS

EP 2123739 A1 11/2009

OTHER PUBLICATIONS

BASEKIM https://www.basekim.com/en/slack-wax; (Nov. 3, 2018) (Year: 2018).*

International Maritime Organization, Method for Reducing Piston Deposits in a Marine Diesel Engine, Oct. 28, 2 016, IMO Sets 2020 Date for Ships to Comply with Low Sulphur Fuel Oil Requirement, XP055669782.

* cited by examiner

*Primary Examiner* — Ellen M Mcavoy
*Assistant Examiner* — Chantel L Graham

(57) ABSTRACT

A method of reducing the incidence of deposits on the pistons of a 4-stroke marine diesel engine during operation of the engine when it is fuelled with a marine residual fuel meeting the ISO 8217 2017 fuel standard for marine residual fuels and having a sulphur content of more than 0.1% and less than 0.5% by mass. The method includes the step of lubricating the engine using a lubricating oil composition comprising:

a) at least 50% by mass, based on the mass of the composition, of an oil of lubricating viscosity;
(b) 5 to 25% by mass, based on the mass of the composition, of an oil-soluble or oil-dispersible alkali metal or alkaline earth metal salicylate detergent, or a mixture of two or more oil-soluble or oil-dispersible alkali metal or alkaline earth metal salicylate detergents;
(c) 0.1 to 10% by mass, based on the mass of the composition of one or more oil-soluble or oil-dispersible ashless dispersants; and optionally,
(d) 0.1 to 10% by mass, based on the mass of the composition of a polyalkylene-substituted succinic anhydride.

14 Claims, No Drawings

METHOD FOR REDUCING PISTON DEPOSITS IN A MARINE DIESEL ENGINE

This invention relates to a method of reducing piston deposits in engines, in particular to a method of reducing the incidence of deposits on the pistons of a 4-stroke marine diesel engine which is fuelled with a marine residual fuel which has a low concentration of sulphur.

Currently, residual fuels used to power marine diesel engines used in shipping operating in offshore regions must have sulphur content of no more than 3.5% by mass, based on the mass of the fuel. However, in common with other transport sectors, there is environmental pressure to reduce harmful emissions attributable to commercial and leisure shipping. Sulphur present in residual fuel is a major cause of environmental pollution. Since January 2015, various parts of the world have introduced Emission Control Areas (ECAs), mainly in coastal regions. In these ECAs, ships may only burn bunker fuels if they have a sulphur content of no more than 0.1% by mass. ECA-compliant fuels are relatively expensive so mandating their use also for offshore shipping would be economically damaging to the global shipping industry. Instead, the International Maritime Organisation (IMO) has mandated a global reduction in the sulphur content of residual fuels used in offshore shipping to no more than 0.5% by mass, based on the mass of the fuel. This cap on the level of sulphur is due to take effect on 1 Jan. 2020.

The IMO's new regulation (referred to as IMO 2020) imposes problems for ship owners and operators but also for fuel refiners and producers. For ship owners, there will be a choice. Either ships must start to operate on the lower sulphur-content fuels or alternatively, existing higher sulphur content (<3.5 mass %) fuel may continue to be used provided that measures are taken to remove atmospheric pollutants caused by its combustion. This latter option involves the use of exhaust gas cleaning systems (often termed 'scrubbers') which are capable of removing in excess of 95% of sulphur oxides and the majority of particulate matter from exhaust gases. There is however a considerable financial cost to ship owners both for the purchase and fitting of scrubbers and due to the non-availability of the ship while the upgraded equipment is being fitted. Some ship owners and operators will find it more commercially attractive to re-fit their ships so as to be able continue to use higher sulphur-content fuel while for others, switching to the lower sulphur-content residual fuel will be more cost-effective. This has a knock-on effect on fuel refiners and producers. Until it is mandated by the IMO regulation, there is no commercial incentive to produce residual fuels having a sulphur content of no more than 0.5 mass % so at present, such fuels are not commercially available.

After 1 Jan. 2020, a market for such fuels will exist, but the size of this market will depend on the proportion of ship owners and operators who decide to use the new fuels and the remainder who choose to fit scrubbers. Fuel refiners and producers will have to decide both how much of the low sulphur-content residual fuels will be needed and the precise types of fuel that they will produce to be compliant with the IMO regulation. There will be numerous different ways to produce compliant residual fuels, for example by using combinations of various refinery streams, suitably treated to reduce sulphur content as necessary. New fuels will also have to meet the existing International standard specification for marine residual fuels, ISO 8217 2017, which specifies properties such as maximum kinematic viscosities, densities, flash points and the like for the various categories of marine residual fuels. The present invention is concerned with engines which are fuelled with residual fuels which both meet the ISO 8217 2017 specification for marine residual fuels and have a sulphur content of no more than 0.5 mass %. ISO 8217 2017 also specifies the International standard for marine distillate fuels, but these are not of relevance to the present invention.

The new lower sulphur-content residual fuels will also require changes in the lubricants used to lubricate marine diesel engines. Traditionally, lubricant manufacturers have formulated their products to operate with fuels having a higher sulphur content. Such fuels produce significant quantities of sulphur oxides on combustion which can lead to high levels of acidic species accumulating in the lubricant. Lubricants have therefore contained chemical species capable of neutralising these acids to prevent corrosion of engine components and degradation of the lubricant. Levels of particulate matter and soot have also been relatively high so species capable of dispersing these in the lubricant have been necessary.

The upcoming move to lower sulphur-content fuels thus present a new challenge to the lubricant formulator. Lubricants designed to lubricate engines fuelled with high sulphur-content fuels will not exhibit optimal performance in the same engines when fuelled with the new fuels.

Previous experience with lubricants designed to lubricate engines fuelled with high sulphur-content residual marine fuels has shown that in the presence of overbased metal detergents, which are necessarily present in order to neutralise acidic combustion products, ashless dispersants have a negative impact on piston cleanliness. This has been attributed to a reduction in the ability of the lubricant to handle asphaltenes which are invariably present in the high sulphur-content residual marine fuel and has been observed in both bench and real engine testing. The use of ashless dispersants in lubricants designed to lubricate engines fuelled with high sulphur-content residual marine fuels has thus been limited to date.

The new marine residual fuels meeting the IMO 2020 regulation will have reduced sulphur-content but will still contain asphaltenes as the processes used to remove sulphur will not ordinarily also remove asphaltenes. Based on previous experience, it could then be expected that the inclusion of ashless dispersants in lubricants used in engines running on these low sulphur-content fuels would similarly lead to poor piston cleanliness. Surprisingly however, the present inventors have found that the combination of a metal detergent and an ashless dispersant in a lubricant used to lubricate an engine fuelled with a marine residual fuel meeting the IMO 2020 regulation (and the ISO 8217 2017 specification for marine residual fuels) actually leads to a reduction in piston deposits compared to a similar lubricant which does not contain any ashless dispersant. Furthermore, it has been found that certain compounds can be added to the combination of a metal detergent and an ashless dispersant to 'boost' this effect and so provide further enhanced piston cleanliness.

Accordingly, in a first aspect, the present invention provides a method of reducing the incidence of deposits on the pistons of a 4-stroke marine diesel engine during operation of the engine when it is fuelled with a marine residual fuel meeting the ISO 8217 2017 fuel standard for marine residual fuels and having a sulphur content of more than 0.1% and less than 0.5% by mass, based on the mass of the fuel, the method comprising lubricating the engine using a lubricating oil composition comprising:

(a) at least 50% by mass, based on the mass of the composition, of an oil of lubricating viscosity;

(b) 5 to 25% by mass, based on the mass of the composition, of an oil-soluble or oil-dispersible alkali metal or alkaline earth metal salicylate detergent, or a mixture of two or more oil-soluble or oil-dispersible alkali metal or alkaline earth metal salicylate detergents, the or each oil-soluble or oil-dispersible alkali metal or alkaline earth metal salicylate detergent having a total base number of (TBN) as measured by ASTM D2896 of from 0 to 500 mg KOH/g;

(c) 0.1 to 10% by mass, based on the mass of the composition of one or more oil-soluble or oil-dispersible ashless dispersants; and optionally, (d) 0.1 to 10% by mass, based on the mass of the composition of a polyalkylene-substituted succinic anhydride.

Preferably, the oil-soluble or oil-dispersible alkali metal or alkaline earth metal salicylate detergent, or a mixture of two or more oil-soluble or oil-dispersible alkali metal or alkaline earth metal salicylate detergents is present in an amount of from 6 to 20 mass %, based on the total mass of the composition, more preferably from 7 to 15 mass %, based on the total mass of the composition. When a mixture of two or more oil-soluble or oil-dispersible alkali metal or alkaline earth metal salicylate detergents is used, these amounts refer to the mass percentage of the mixture present in the composition.

The method involves fuelling a 4-stroke marine diesel engine with a marine residual fuel which meets the ISO 8217 2017 fuel standard for marine residual fuels and has a sulphur content of more than 0.1% and less than 0.5% by mass, based on the mass of the fuel. Any residual fuel which meets these criteria is suitable to perform the method of the claimed invention but preferably, the marine residual fuel comprises one, or a mixture of two or more, residual refinery streams chosen from atmospheric tower bottoms, vacuum tower bottoms, light cycle oil, heavy cycle oil, fluid catalytic cracked cycle oil, fluid catalytic cracked slurry oil, thermally cracked residue, thermal tar, unfluxed tar, thermally cracked heavy distillate, Group I slack wax, deasphalted oil, thermally cracked kerosene gas-to-liquid wax, hydrotreated light cycle oil, hydrotreated heavy cycle oil, hydrotreated fluid catalytic cracked cycle oil, hydrotreated thermally cracked heavy distillates, hydrotreated bottoms, hydrocracker hydrowax and hydrotreated hydrocracker deasphalted oil. Preferably, the marine residual fuel comprises a mixture of two or more of these residual refinery streams.

More preferably, the marine residual fuel consists essentially of one or a mixture of two or more residual refinery streams chosen from atmospheric tower bottoms, vacuum tower bottoms, light cycle oil, heavy cycle oil, fluid catalytic cracked cycle oil, fluid catalytic cracked slurry oil, thermally cracked residue, thermal tar, unfluxed tar, thermally cracked heavy distillate, Group I slack wax, deasphalted oil, thermally cracked kerosene gas-to-liquid wax, hydrotreated light cycle oil, hydrotreated heavy cycle oil, hydrotreated fluid catalytic cracked cycle oil, hydrotreated thermally cracked heavy distillates, hydrotreated bottoms, hydrocracker hydrowax and hydrotreated hydrocracker deasphalted oil. More preferably, the marine residual fuel consists essentially of a mixture of two or more of these residual refinery streams.

Fuels compliant with IMO 2020 will have to meet the ISO 8217 2017 fuel standard for marine residual fuels and have the required low sulphur content but will be variable in composition and physical properties, dependent on the residual streams which are used in their production. Choosing which blend components to use will involve a complex calculation based on factors including availability, cost, compatibility and stability impacts and refinery design.

The lubricating oil composition comprises (b) an oil-soluble or oil-dispersible alkali metal or alkaline earth metal salicylate detergent, or a mixture of two or more oil-soluble or oil-dispersible alkali metal or alkaline earth metal salicylate detergents. Such detergents are known in the art.

A detergent is an additive that reduces formation of piston deposits, for example high-temperature varnish and lacquer deposits, in engines; it normally has acid-neutralising properties and is capable of keeping finely divided solids in suspension. Most detergents are based on "soaps", that is metal salts of acidic organic compounds. Accordingly, the lubricating oil composition of the present invention includes an alkali metal or alkaline earth metal salt of salicylic acid as the soap i.e. salicylate soap.

Preferably, the oil-soluble or oil-dispersible alkali metal or alkaline earth metal salicylate detergent, or a mixture of two or more oil-soluble or oil-dispersible alkali metal or alkaline earth metal salicylate detergents provides the lubricating oil composition with from 30 to 100, preferably 40 to 90, more preferably 50 to 80, mmol of salicylate soap per kilogram of the lubricating oil composition. When a mixture of two or more oil-soluble or oil-dispersible alkali metal or alkaline earth metal salicylate detergents is used, these ranges refer to the amount of salicylate soap provided by the mixture.

By the term "salicylate soap" we mean the amount of alkali metal or alkaline earth metal salicylate salt contributed by the one or more alkali metal or alkaline earth metal salicylate detergent(s) exclusive of any overbasing material.

The number of moles of alkali metal or alkaline earth metal salicylate salt (salicylate soap) can be derived by employing titrimetry, including two phase titrimetric methods, total acid number (TAN) as determined using ASTM D664, dialysis and other well-known analytical techniques. The total amount of metal must be determined and allocated between salicylic acids and inorganic acids using a metal ratio. The total amount of metal present is conveniently determined by inductively coupled plasma atomic emission spectrometry—ASTM D4951. Metal ratio is defined as the total amount of metal present divided by the amount of metal in excess of that required to neutralize any salicylic acid(s) present, i.e., the amount of metal neutralizing inorganic acids. Metal ratios are quoted by manufacturers of commercial detergents and can be determined by a manufacturer having knowledge of the total amount of salts present and the average molecular weight of the salicylic acid(s). The amount of alkali metal or alkaline earth metal salicylate salt present in a detergent may be determined by dialyzing the detergent and quantifying the amount of the residue. If the average molecular weight of the salicylic salts is not known, the residue from the dialyzed detergent can be treated with strong acid to convert the salt to its acid form, analyzed by chromatographic methods, proton NMR, and mass spectroscopy and correlated to salicylic acids of known properties. More particularly, the detergent is dialysed and then the residue is treated with strong acid to convert any salts to their respective acid forms. The hydroxide number of the mixture can then be measured by the method described in ASTM D1957. As salicylic acids include hydroxyl functional groups separate analyses must be conducted to quantify the amounts of those hydroxyl groups so that the hydroxide number determined by ASTM D1957 can be corrected.

Alternatively, a second method for deriving the number of moles of alkali metal or alkaline earth metal salicylate salt (salicylate soap) assumes that all of the salicylic acid(s) charged to make the detergent is in fact converted to the salt. Both of these two methods allow determination of the amount of salicylate soap present in the detergent.

The salicylic acid(s) are typically prepared by carboxylation, for example by the Kolbe-Schmitt process, of phenoxides. Processes for overbasing the salicylic acid(s) are known to those skilled in the art.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a total base number or TBN at 100% active mass (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN at 100% active mass of 100 or greater, and typically of from 200 to 500 or more.

Suitably, the one or more alkali metal or alkali earth metal salicylate detergent(s) may be neutral or overbased. The one or more alkali metal or alkali earth metal salicylate detergent(s) has a TBN at 100% active mass of from 0 to 500 mg KOH/g (as may be measured by ASTM D2896). Preferably, the one or more alkali metal or alkaline earth metal salicylate detergent(s) is an overbased alkali metal or alkaline earth metal salicylate detergent. Preferably, the one or more overbased alkali metal or alkaline earth metal salicylate detergent(s) has a TBN at 100% active mass (as may be measured by ASTM D2896) of from 50 to 500 mg KOH/g, preferably from 100 to 500 mg KOH/g, more preferably from 150 to 500 mg KOH/g, even more preferably from 200 to 500 mg KOH/g, for example from 250 to 500 mg KOH/g.

Preferably, the oil-soluble or oil-dispersible alkali metal or alkaline earth metal salicylate detergent, or a mixture of two or more oil-soluble or oil-dispersible alkali metal or alkaline earth metal salicylate detergents is one or more alkali metal or alkaline earth metal $C_8$ to $C_{30}$ alkyl salicylate detergent(s), more preferably one or more alkali metal or alkaline earth metal $C_{10}$ to $C_{20}$ alkyl salicylate detergents(s), most preferably one or more alkali metal or alkaline earth metal $C_{14}$ to $C_{18}$ alkyl salicylate detergent(s). The alkyl group(s) may be linear or branched and examples of suitable alkyl groups include: octyl; nonyl; decyl; dodecyl; pentadecyl; octadecyl; eicosyl; docosyl; tricosyl; hexacosyl; and, triacontyl. The salicylate detergent(s), as defined herein, may also include sulfurized derivatives thereof.

Preferably, the one or more alkali metal or alkaline earth metal salicylate detergent(s) is one or more alkaline earth metal salicylate detergents. Calcium and magnesium salicylate detergents are particularly preferred, especially calcium salicylate detergents.

Preferably, the oil-soluble or oil-dispersible alkali metal or alkaline earth metal salicylate detergent, or a mixture of two or more oil-soluble or oil-dispersible alkali metal or alkaline earth metal salicylate detergents provides the lubricating oil composition with greater than or equal to 0.3, more preferably greater than or equal to 0.4, more preferably greater than or equal to 0.5 mass % of metal as measured by ASTM D5185, based on the total mass of the lubricating oil composition. Preferably, the oil-soluble or oil-dispersible alkali metal or alkaline earth metal salicylate detergent, or a mixture of two or more oil-soluble or oil-dispersible alkali metal or alkaline earth metal salicylate detergents provides the lubricating oil composition with less than or equal to 1.5, more preferably less than or equal to 1.3, even more preferably less than or equal to 1.2 mass % of metal as measured by ASTM D5185, based on the total mass of the lubricating oil composition.

Other metal containing detergents may be present in the lubricating oil composition and include oil-soluble salts of neutral and overbased sulfonates, phenates, sulfurized phenates, thiophosphonates and naphthenates of a metal, particularly the alkali or alkaline earth metals, e.g. sodium, potassium, lithium, calcium and magnesium. The most commonly used metals are calcium and magnesium, which may both be present in detergents used in a lubricant, and mixtures of calcium and/or magnesium with sodium. Detergents may be used in various combinations.

In a preferred embodiment, the oil-soluble or oil-dispersible alkali metal or alkaline earth metal salicylate detergent, or a mixture of two or more oil-soluble or oil-dispersible alkali metal or alkaline earth metal salicylate detergents represent the only metal containing detergent(s) in the lubricating oil composition.

The lubricating oil composition comprises (c) one or more oil-soluble or oil-dispersible ashless dispersants. The ashless dispersants useful for the present invention suitably comprise an oil soluble polymeric long chain backbone having functional groups capable of associating with particles to be dispersed. Typically, such dispersants have amine, amine-alcohol or amide polar moieties attached to the polymer backbone, often via a bridging group. A suitable ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Dispersants suitable for lubricating oil compositions used in the present invention may preferably be derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5 functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times \mathrm{MW})) \quad (1)$$

wherein SAP is the saponification number (i.e., the number of milligrams of KOH consumed in the complete neutralization of the acid groups in one gram of the reaction product, as determined according to ASTM D94); $M_n$ is the number average molecular weight of the starting olefin polymer; A.I. is the percent active ingredient of the reaction product (the remainder being unreacted olefin polymer, carboxylic acid, anhydride or ester and diluent); and MW is the molecular weight of the carboxylic acid, anhydride or ester (e.g., 98 for succinic anhydride).

Generally, each mono- or dicarboxylic acid-producing moiety will react with a nucleophilic group (amine, alcohol, amide or ester polar moieties) and the number of functional groups in the polyalkenyl-substituted carboxylic acylating agent will determine the number of nucleophilic groups in the finished dispersant.

The polyalkenyl moiety of the dispersant preferably has a number average molecular weight of at least 450, suitably at least 700, preferably at least 900 such as from 450 to 3000, preferably from 700 to 3000, more preferably from 900 to 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

Polymer molecular weight, specifically $\overline{Mn}_n$, can be determined by various known techniques. One convenient method is gel permeation chromatography (GPC), which additionally provides molecular weight distribution information (see W. W. Yau, J. J. Kirkland and D. D. Bly, "Modem Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

The polyalkenyl moiety suitable for forming a dispersant useful in the lubricating oil composition used in the present invention preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from 1.5 to 2.1, preferably from 1.6 to 1.8.

Suitable hydrocarbons or polymers employed in the formation of dispersants include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms Another useful class of polymers is polymers prepared by cationic polymerization of isobutene, styrene, and the like. Common polymers from this class include polyisobutenes obtained by polymerization of a $C_4$ refinery stream having a butene content of 35 to 75% by mass, and an isobutene content of 30 to 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from 450 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated a-olefin polymer to 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for 0.5 to 10 hours, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually 180° C. to 235° C., for 0.5 to 10 hours, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

Monounsaturated reactants that may be used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from equimolar amount to 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nucleophilic reactant, such as an amine, amino-alcohol, alcohol, metal compound, or mixture thereof, to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., poly alkene and polyoxyalkylene polyamines of 2 to 60, such as 2 to 40 (e.g., 3 to 20) total carbon atoms having 1 to 12, such as 3 to 12, preferably 3 to 9, most preferably form 6 to 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyalkylene polyamine mixtures, known as PAM, are commercially available. Particularly preferred polyalkylene polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Dispersant(s) used in lubricating oil compositions in the method of the present invention may be borated by conventional means, as generally taught in U.S. Patent Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from 0.1 to 20 atomic proportions of boron for each mole of acylated nitrogen composition.

The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding a sufficient quantity of a boron compound, preferably boric acid, usually as a slurry, to the acyl nitrogen compound and heating with stirring at from 135° C. to 190° C., e.g., 140° C. to 170° C., for from 1 to 5 hours, followed by nitrogen stripping. Alternatively, the boron treatment can be conducted by adding boric acid to a hot reaction mixture of the dicarboxylic acid material and amine, while removing water. Other post reaction processes known in the art can also be applied.

If a borated dispersant is present in a lubricating oil composition, the amount of boron provided to the lubricating oil composition by the borated dispersant is suitably at least 10, such as at least 30, for example, at least 50 or even at least 65 ppm of boron, based on the total mass of the lubricating oil composition. If present, the borated ashless dispersant suitably provides no more than 1000, preferably no more than 750, more preferably no more than 500 ppm of boron to the lubricating oil composition, based on the total mass of the lubricating oil composition.

In a preferred embodiment, the one or more oil-soluble or oil-dispersible ashless dispersant comprises a succinimide formed by the reaction of a polyisobutylene-substituted succinic anhydride with a polyalkylene polyamine, preferably a mixture of polyalkylene polyamines. The number average molecular weight of the polysiobutylene group is suitably at least 450, preferably at least 700, more preferably at least 900 such as from 450 to 3000, preferably from 700 to 3000, more preferably from 900 to 2400. In the embodiment where more than one oil-dispersible ashless dispersant is employed, preferably each is a succinimide formed by the reaction of a polyisobutylene-substituted succinic anhydride with a polyalkylene polyamine, preferably a mixture of polyalkylene polyamines, wherein the number average molecular weight of the polysiobutylene group of one dispersant is between 900 and 1500 and the number average molecular weight of the polysiobutylene group of another dispersant is between 1800 and 3000. In a particularly preferred embodiment, two oil-soluble or oil-dispersible ashless dispersants are used, each being a succinimide formed by the reaction of a polyisobutylene-substituted succinic anhydride with a mixture of polyalkylene polyamines, wherein the number average molecular weight of the polysiobutylene group of one dispersant is between 900 and 1000 and the number average molecular weight of the polysiobutylene group the other dispersant is between 2000 and 2500.

Preferably, the one or more oil-soluble or oil-dispersible ashless dispersant is present in the lubricating oil composition in an amount of from 0.4 to 10 mass %, preferably 0.5 to 8 mass %, more preferably 1 to 5 mass %, based on the mass of the composition.

The lubricating oil composition may optionally further comprise (d) a polyalkylene-substituted succinic anhydride.

These compounds include those described in relation to component (c) hereinabove as functionalized oil-soluble polymeric hydrocarbon backbones prior to their derivatization with the nucleophilic reactant. Preferred are polyisobutylene-substituted succinic anhydrides where the polyisobutylene group has a number average molecular weight of at least 450, preferably at least 700, more preferably at least 900 such as from 450 to 3000, preferably from 700 to 3000, more preferably from 900 to 2400. A preferred compound (d) is a polyisobutylene-substituted succinic anhydride where the polyisobutylene group has a number average molecular weight of between 900 and 1000.

In a preferred embodiment, the lubricating oil composition further comprises (d) a polyalkylene-substituted succinic anhydride, preferably a polyisobutylene-substituted succinic anhydride as described above.

When present, preferably the polyalkylene-substituted succinic anhydride (d) is present in the lubricating oil composition in an amount of from 0.1 to 10 mass %, preferably 0.2 to 8 mass %, more preferably 0.5 to 6 mass %, based on the mass of the composition.

At least 50% by mass of the lubricating oil composition used in the present invention comprises (a) an oil of lubricating viscosity. Such oils may range in viscosity from light distillate mineral oils to heavy lubricating oils. Generally, the viscosity of the oil ranges from 2 to 40, such as 3 to 15, $mm^2$/sec, as measured at 100° C., and has a viscosity index of 80 to 100, such as 90 to 95.

Natural oils include animal oils and vegetable oils (e.g., castor oil, lard oil); liquid petroleum oils and hydrorefined, solvent-treated or acid-treated mineral oils of to the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivatives, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment are unrefined oils.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock are tabulated below:

TABLE E-1

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention preferably embraces those of the above oils containing greater than or equal to 90% saturates and less than or equal to 0.03% sulphur as the oil of lubricating viscosity, e.g. Group II, III, IV or V. They also include basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil. The invention is not however limited to use of the above-mentioned base stocks; thus it may, for example, include use of Group I basestocks and of bright stock.

Preferably, the oil of lubricating viscosity in this invention contains 50 mass % or more of said basestocks. It may contain 60, such as 70, 80 or 90, mass % or more of said basestock or a mixture thereof. The oil of lubricating viscosity may be substantially all of said basestock or a mixture thereof.

Preferably, the lubricating oil composition used in the method of the present invention comprises at least 60% by mass, based on the mass of the composition, for example at least 70% by mass, or at least 80% by mass, of an oil of lubricating viscosity.

Other additives may optionally be present in the lubricating oil composition used in the method of the present invention.

In an embodiment, the lubricating oil composition further comprises one or more anti-wear additives. Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with P2S5 and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

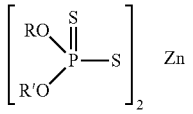

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

The ZDDP is added to the lubricating oil compositions in amounts sufficient to provide no greater than 1200 ppm, preferably no greater than 1000 ppm, more preferably no greater than 900 ppm, most preferably no greater than 850 ppm by mass of phosphorous to the lubricating oil, based upon the total mass of the lubricating oil composition, and as measured in accordance with ASTM D5185. The ZDDP is suitably added to the lubricating oil compositions in amounts sufficient to provide at least 100 ppm, preferably at least 200 ppm, for example from 200 to 400pp, by mass of phosphorous to the lubricating oil, based upon the total mass of the lubricating oil composition, and as measured in accordance with ASTM D5185. Mixtures of two or more anti-wear additives, for example two or more different ZDDP compounds may be used.

Other additives (or co-additives) which may also be present in the lubricating oil compositions used in the method of the present invention are described hereinbelow. Amounts of co-additives, when present, are as stated below in mass percent active ingredient in the lubricating oil composition.

| Additive | Mass % (Broad) | Mass % (Preferred) |
|---|---|---|
| Additional Metal Detergents | 0.1-15 | 0.2-9 |
| Corrosion/Rust Inhibitor | 0-5 | 0-1.5 |
| Anti-Oxidants | 0-5 | 0.01-3 |
| Anti-Foaming Agent | 0-5 | 0.001-0.15 |
| Supplemental Anti-Wear Agents | 0-5 | 0-2 |

As is known in the art, some additives can provide a multiplicity of effects.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used but are typically not required with the formulation of the present invention. Typically, such compounds are the thiadiazole polysulfides containing from 5 to 50 carbon atoms, their derivatives and polymers thereof. Derivatives of 1, 3, 4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating oil composition, they are preferably present in an amount not exceeding 0.2 wt. % active ingredient.

A small amount of a demulsifying component may be used. A preferred demulsifying component is described in EP 330522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam control can be provided by many compounds including an anti-foaming agent of the polysiloxane type, for example, silicone oil or polydimethyl siloxane.

The individual additives, both the essential components (b) and (c), the optional component (d), and any co-additives may be incorporated into the oil of lubricating viscosity in any convenient way. Thus, each of the components can be added directly to the oil of lubricating viscosity by dispersing or dissolving them in the oil of lubricating viscosity at the desired concentration. Such blending may occur at ambient or elevated temperatures.

Preferably, all components are blended into a concentrate or additive package and that concentrate or additive package is then subsequently blended into the oil of lubricating viscosity to make the finished lubricating oil composition. The concentrate will typically be formulated to contain the additive(s) in proper amounts to provide the desired concentration in the final formulation when the concentrate is combined with a predetermined amount of the oil of lubricating viscosity.

Concentrates are preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

In a second aspect, the present invention provides the use of a lubricating oil composition as defined in relation to the first aspect to reduce the incidence of deposits on the pistons of a 4-stroke marine diesel engine during operation of the engine when it is fuelled with a marine residual fuel meeting the ISO 8217 2017 fuel standard for marine residual fuels and having a sulphur content of more than 0.1% and less than 0.5% by mass, based on the mass of the fuel.

The invention will now be described by way of example only.

Lubricating oil compositions were prepared as shown in Table 1 below. Quantities given are in mass %, based on the total mass of the oil composition.

TABLE 1

| Component | Oil 1 | Oil 2 | Oil 3 |
|---|---|---|---|
| Disp 1 | — | 0.600 | 0.600 |
| Disp 2 | — | 2.000 | 2.000 |
| Det 1 | 3.755 | 3.755 | 3.755 |
| Det 2 | 5.331 | 5.331 | 5.331 |
| ZDDP | 0.300 | 0.300 | 0.300 |
| PIBSA | — | — | 1.000 |
| Gp II oil | Balance | Balance | Balance |

The components used were are follows:

Disp 1: a borated (1.3 mass % B) ashless dispersant being a succinimide formed by the reaction of a polyisobutylene-substituted succinic anhydride with a polyalkylene polyamine, the polyisobutylene group having a number average molecular weight of 950.

Disp 2: a non-borated ashless dispersant being a succinimide formed by the reaction of a polyisobutylene-substituted succinic anhydride with a polyalkylene polyamine, the polyisobutylene group having a number average molecular weight of 2225.

Det 1: a calcium salicylate detergent having a TBN as measured by ASTM D2896 of 350 mg KOH/g and a calcium content of 12.5 mass %.

Det 2: a calcium salicylate detergent having a TBN as measured by ASTM D2896 of 225 mg KOH/g and a calcium content of 8 mass %. 1

ZDDP: a zinc dialkyldithiophosphate where the 60% of the alkyl groups are 1° $C_4$ groups and 40% are 1° $C_5$ groups, and the zinc content is 8.8 mass %.

PIBSA: a polyisobutylene-substituted succinic anhydride where the polyisobutylene group has a number average molecular weight of 950.

Gp II oil: an API Group II mineral oil.

The lubricating oil compositions were evaluated for asphaltene dispersancy using the Focused Beam Reflectance Method (FBRM). This technique provides a measurement of asphaltene agglomeration and so is indicative of the tendency of the lubricating oil to form piston deposits when used to lubricate an engine.

The FBRM test method utilises a fibre optic probe. The tip of the probe contains an optic which focuses the laser light to a small spot. The optic is rotated so that the focussed beam scans a circular path over a window, past which the oil sample to be measured flows. As asphaltene particles in the oil flow past the window they intersect the scanning light path and backscattered light from the particles is collected. The scanning laser beam travels much faster than the particles which means that relative to the light, the particles are effectively stationary. As the focussed beam intersects one edge of a particle, the amount of backscattered light collected increases, decreasing again as the beam reaches the other edge of the particle. The instrument determines the time period over which increased backscattered light is detected. Multiplying this time period by the scan speed of the laser provides a distance. This distance is a chord length as it is the length of a straight line between two points on the edge of a particle. The FBRM technique measures tens of thousands of chord lengths per second so provides a chord length distribution, usually expressed in microns. An accurate measure of the particle size distribution of asphaltene particles in the sample is thus obtained.

The FBRM equipment used was model Lasentec G400 supplied by Mettler Toledo, Leicester, UK. It was configured to give a particle size resolution of between 1 μm and 1 mm. data obtained can be presented in several ways but our studies have shown that the average counts per second can be used as a quantitative measure of asphaltene dispersancy. This value is a function of both the average particle size and the degree of agglomeration.

Five different marine residual fuels were used. These are detailed in Table 2 below.

TABLE 2

| | Sulphur content (mass %) | Asphaltene content (mass %) |
|---|---|---|
| Fuel 1 | 1.9 | 32.11 |
| Fuel 2 | 2.5 | 24.70 |
| Fuel 3 | 1.2 | 12.75 |
| Fuel 4 | 0.47 | 15.25 |
| Fuel 5 | 0.47 | 21.76 |

Fuels 1-3 are examples of marine residual fuels which meet the current regulations for such fuels in that they have sulphur contents which are below 3.5 mass % and meet the ISO 8217 2017 fuel standard for marine residual fuels. These fuels will not be able to be used after 1 Jan. 2020 unless the ships in which they are used are fitted with appropriate exhaust gas cleaning systems.

Fuels 4 and 5 are examples of marine residual fuels which will be able to be used after 1 Jan. 2020 as they have sulphur contents which are below 0.5 mass %. They also meet the requirements of the ISO 8217 2017 fuel standard for marine residual fuels.

It is noteworthy that both higher sulphur-content fuels and low sulphur-content fuels have appreciable and similar asphaltene contents. Asphaltene content was determined by the 'pentane in-solubles' method set out in Appendix X1 of ASTM D2007-11.

As a first step, individual samples (880 g) of each of the lubricating oil compositions detailed in Table 1 were artificially aged by heating to 140° C. with stirring in a multi-necked, flat-bottomed flask and passing air through the oil through sintered glass tubes at a flow rate of 45 litres/hour for 48 hours.

Individual samples (49.5 g each) of the lubricating oil compositions aged as above were then heated to 60° C. and maintained at that temperature while being stirred. Weighed samples (9.90 g) of each of the fuels listed in Table 2 were added to each oil sample. The FBRM probe was inserted into each mixture and measurements collected for 15 minutes. The results obtained, expressed as average counts per second are detailed in Table 3 below. Each data point is the average of two individual measurements on each sample.

TABLE 3

| | Fuel 1 | Fuel 2 | Fuel 3 | Fuel 4 | Fuel 5 |
|---|---|---|---|---|---|
| Oil 1 | 18126 | 31370 | 1324 | 101.4 | 48280 |
| Oil 2 | 34282 | 47583 | 2899 | 61.6 | 10854 |
| Oil 3 | 31341 | 41651 | 1750 | 50.4 | 3801 |

A distinct pattern of behaviour was evident for the fuels having a high sulphur-content (Fuels 1-3). Comparing results for Oil 1 and Oil 2, it is clear that the addition dispersant greatly reduced the ability of the oil to disperse asphaltenes, evidenced by the large increase in the average counts per second recorded. Some improvement was seen on the further addition of PIBSA (compare Oils 2 and 3) but the performance of Oil 3 was still significantly worse in each case than Oil 1.

An equally distinct but contrasting trend was seen for the fuels with a low sulphur-content (Fuels 4 and 5). Here, the addition of dispersant (compare Oil 1 and Oil 2) led to a marked increase in the ability of the oil to disperse asphaltenes, behaviour which was further improved by the addition of PIBSA (compare Oils 2 and 3).

These data illustrate that the method of the present invention enables a reduction in the incidence of piston deposits in a 4-stroke marine diesel engine when run on a residual fuel which is compliant with the upcoming IMO 2020 regulation.

Oils 1, 2 and 3 as described in Table 1 above, were evaluated for cleanliness performance using a Ricardo Atlas II 4-stroke single cylinder medium speed engine. Each was 60 hours in duration, running at full engine load and maximum rated speed under the following conditions:

TABLE 4

| Feature | |
|---|---|
| Bore | 159 mm |
| Stroke | 159 mm |
| Power @ rated speed | 71 kW @ 1500 rpm |
| Torque @ speed | 452 Nm @ 1500 rpm |
| BMEP | 18 bar |
| Cylinder pressure | 160 bar |

This test provides a measurement of the capability of lubricant to prevent deposition. A commercial very low sulphur heavy fuel oil (VLSFO) meeting the RMG380 specification was used for these tests (Fuel 6). It had a sulphur content below 0.5 mass % and met the requirements of the ISO 8217 2017 fuel standard for marine residual fuels.

TABLE 5

| | Sulphur content (mass %) | Asphaltene content (mass %) |
|---|---|---|
| Fuel 6 | 0.49 | 15.65 |

Upon test completion the upper areas of the piston and ring assembly were visually rated (via DIN 51349-3) for deposit that had formed during operation. Results are given in Table 6.

TABLE 6

| | Top Land | 2nd Land | Groove 1 | Groove 2 | Total Deposits (points) |
|---|---|---|---|---|---|
| Oil 1 | 19.75 | 43.65 | −3.70 | 8.00 | 67.70 |
| Oil 2 | 24.90 | 41.65 | −1.80 | 12.25 | 76.80 |
| Oil 3 | 27.70 | 54.60 | −4.50 | 14.45 | 92.25 |

Comparing results for Oil 1 with Oil 2 and Oil 3, it is clear that the addition of dispersant reduced deposit levels in the engine when run using a marine residual fuel having a sulphur content below 0.5 mass % and meeting the requirements of the ISO 8217 2017 fuel standard for marine residual fuels.

What is claimed is:

1. A method of reducing the incidence of deposits on the pistons of a 4-stroke marine diesel engine during operation of the engine when it is fuelled with a marine residual fuel meeting the ISO 8217 2017 fuel standard for marine residual fuels and having a sulphur content of more than 0.1% and less than 0.5% by mass, based on the mass of the fuel, the method comprising lubricating the engine using a lubricating oil composition comprising:

(a) at least 50% by mass, based on the mass of the composition, of an oil of lubricating viscosity;

(b) 5 to 25% by mass, based on the mass of the composition, of an oil-soluble or oil-dispersible alkali metal or alkaline earth metal salicylate detergent, or a mixture of two or more oil-soluble or oil-dispersible alkali metal or alkaline earth metal salicylate detergents, the or each oil-soluble or oil-dispersible alkali metal or alkaline earth metal salicylate detergent having a total base number of (TBN) as measured by ASTM D2896 of from 50 to 500 mg KOH/g;

(c) 0.1 to 10% by mass, based on the mass of the composition of one or more oil-soluble or oil-dispersible ashless dispersants; and optionally, (d) 0.1 to 10% by mass, based on the mass of the composition of a polyalkylene-substituted succinic anhydride, wherein the lubricating oil composition provides the engine with reduced asphaltene agglomeration and/or reduced deposits on piston and ring assemblies, as compared with a lubricating oil composition lacking component (c) and/or component (d).

2. A method according to claim 1 wherein the marine residual fuel comprises one, or a mixture of two or more, residual refinery streams chosen from atmospheric tower bottoms, vacuum tower bottoms, light cycle oil, heavy cycle oil, fluid catalytic cracked cycle oil, fluid catalytic cracked slurry oil, thermally cracked residue, thermal tar, unfluxed tar, thermally cracked heavy distillate, Group I slack wax, deasphalted oil, thermally cracked kerosene gas-to-liquid wax, hydrotreated light cycle oil, hydrotreated heavy cycle oil, hydrotreated fluid catalytic cracked cycle oil, hydrotreated thermally cracked heavy distillates, hydrotreated bottoms, hydrocracker hydrowax and hydrotreated hydrocracker deasphalted oil.

3. A method according to claim 1 wherein the marine residual fuel consists essentially of one or a mixture of two or more residual refinery streams chosen from atmospheric tower bottoms, vacuum tower bottoms, light cycle oil, heavy cycle oil, fluid catalytic cracked cycle oil, fluid catalytic cracked slurry oil, thermally cracked residue, thermal tar, unfluxed tar, thermally cracked heavy distillate, Group I slack wax, deasphalted oil, thermally cracked kerosene gas-to-liquid wax, hydrotreated light cycle oil, hydrotreated heavy cycle oil, hydrotreated fluid catalytic cracked cycle oil, hydrotreated thermally cracked heavy distillates, hydrotreated bottoms, hydrocracker hydrowax and hydrotreated hydrocracker deasphalted oil.

4. A method according to claim 1 wherein the alkali metal or alkaline earth metal is calcium.

5. A method according to claim 1 wherein the oil-soluble or oil-dispersible alkali metal or alkaline earth metal salicylate detergent, or a mixture of two or more oil-soluble or oil-dispersible alkali metal or alkaline earth metal salicylate detergents is present in an amount of from 6 to 20 mass %, based on the total mass of the composition.

6. A method according to claim 4 wherein the oil-soluble or oil-dispersible alkali metal or alkaline earth metal salicylate detergent, or a mixture of two or more oil-soluble or oil-dispersible alkali metal or alkaline earth metal salicylate detergents is present in an amount of from 6 to 20 mass %, based on the total mass of the composition.

7. A method according to claim 1 wherein the one or more oil-soluble or oil-dispersible ashless dispersants comprises a succinimide formed by the reaction of a polyisobutylene-substituted succinic anhydride with a polyalkylene polyamine.

8. A method according to claim 4 wherein the one or more oil-soluble or oil-dispersible ashless dispersants comprises a succinimide formed by the reaction of a polyisobutylene-substituted succinic anhydride with a polyalkylene polyamine.

9. A method according to claim 5 wherein the one or more oil-soluble or oil-dispersible ashless dispersants comprises a succinimide formed by the reaction of a polyisobutylene-substituted succinic anhydride with a polyalkylene polyamine.

10. A method according to claim 1 wherein the lubricating oil composition comprises (d) a polyisobutylene-substituted succinic anhydride.

11. A method according to claim 10 wherein the lubricating oil composition wherein said polyalkylene-substituted succinic anhydride is a polyisobutylene-substituted succinic anhydride.

12. A method according to claim 1 wherein the lubricating oil composition further comprises one or more anti-wear additives.

13. A method according to claim 12 wherein the one or more antiwear additives comprises a dihydrocarbyl dithiophosphate metal salt, preferably a zinc dihydrocarbyl dithiophosphate salt.

14. A method according to claim 1, wherein the asphaltene agglomeration is measured at ~60° C. on compositions aged at ~140° C. according to a Focused Beam Reflectance Method (FBRM) and reported as average counts per second over a ~15-minute period, and wherein the piston and ring deposits are visually rated according to DIN 51349-3 on Top Land, $2^{nd}$ Land, Groove 1, and Groove 2 after ~60 hours in an engine running at full engine load and maximum rated speed under the conditions listed in Table 4.

* * * * *